United States Patent [19]

Saulle

[11] Patent Number: 4,877,157

[45] Date of Patent: Oct. 31, 1989

[54] DISPENSER FOR FLUID PRODUCTS

[75] Inventor: Lorenzo Saulle, Pieve Emanuele, Italy

[73] Assignee: Stacos di Saulle Lorenzo e Pontarollo Luciana s.n.c., Milan, Italy

[21] Appl. No.: 315,350

[22] Filed: Feb. 23, 1989

Related U.S. Application Data

[63] Continuation of Ser. No. 11,105, Feb. 5, 1987, abandoned.

[30] Foreign Application Priority Data

Feb. 6, 1986 [IT] Italy ..... 19323 A/86
Jul. 31, 1986 [IT] Italy ..... 21352 A/86

[51] Int. Cl.[4] ..... B65D 83/14

[52] U.S. Cl. ..... 222/387; 222/389; 222/402.1

[58] Field of Search ..... 222/386, 389, 129, 130, 222/131, 340, 341, 394, 635, 249, 250, 383.5, 387, 388, 401, 402, 400.5, 402.1; 92/165 R; 141/3, 20; 239/231, 232, 233

[56] References Cited

U.S. PATENT DOCUMENTS

| | | | |
|---|---|---|---|
| 436,406 | 9/1890 | Eccles | 239/32 X |
| 1,422,112 | 7/1922 | Lord | 222/340 X |
| 1,565,888 | 12/1925 | Aussenhofer | 222/387 X |
| 1,633,519 | 8/1925 | Crowell | 222/341 X |
| 2,809,774 | 10/1957 | Kaye et al. | 222/389 X |
| 3,186,597 | 6/1965 | Henderson | 222/389 X |
| 3,207,385 | 9/1965 | Featherstone et al. | 222/389 |
| 3,268,123 | 8/1966 | Spatz | 222/400.5 |
| 3,282,474 | 11/1966 | Gorman | 222/389 |
| 3,300,103 | 1/1967 | Featherstone et al. | 222/389 |
| 3,312,378 | 4/1967 | Featherstone et al. | 222/389 |
| 3,377,003 | 4/1968 | Bacon et al. | 222/389 |
| 3,421,664 | 1/1969 | Sokol | 222/340 |
| 3,828,980 | 8/1974 | Creighton et al. | 222/386 X |
| 4,106,674 | 8/1978 | Schultz | 222/389 X |
| 4,108,219 | 8/1978 | Shulsinger | 222/389 |
| 4,223,808 | 9/1980 | Williams et al. | 272/88 |
| 4,231,492 | 11/1980 | Rios | 222/387 X |
| 4,651,899 | 3/1987 | Pauls et al. | 222/130 |

FOREIGN PATENT DOCUMENTS

| | | | |
|---|---|---|---|
| 0116478 | 8/1984 | European Pat. Off. . | |
| 2015655 | 3/1979 | United Kingdom | 222/389 |

*Primary Examiner*—Joseph J. Rolla
*Attorney, Agent, or Firm*—Bucknam and Archer

[57] ABSTRACT

As dispenser for fluid products such as perfumes, soaps, deodorizers, insecticides, varnishes, enamels, etc., comprises a chamber (2), containing a fluid to be dispensed and provided with a dispensing valve (10); a seal sliding piston (4) in the chamber (2), and a propellant medium (17) acting on the piston (4) and positioned in a conduit (3) or a chamber coaxial with the chamber (2). The propellant medium may be a spiral spring or compressed air, the pre-charging of which is proportional to the quantity of fluid to be dispensed. When the propellant medium is compressed air, it is contained in a coaxial chamber, annular and external to that of fluid to be dispensed; the external chamber is connected to the bottom of piston (4) by means of radial holes made on the surface of the inner chamber.

1 Claim, 3 Drawing Sheets

DISPENSER FOR FLUID PRODUCTS

This is a continuation of application Ser. No. 011,105, filed Feb. 5, 1987 now abandoned.

This invention refers to a dispenser for fluid products.

More particularly, this invention refers to a dispenser for fluid products of the type comprising a chamber for containing a fluid and a propellant which thrusts the fluid out of the chamber through a valve.

It is known that most fluid products in general, such as for instance perfumes, soaps, deodorizers, creams, lacquers, bonding agents, foodstuffs, insecticides, tanning agents, varnishes, enamels, oils, fats, and so on, are preferably packaged in so-called "spray aerosols". These consist of a container, in which the fluid product to be dispensed is inserted through a filling inlet which is then sealed by means of a seal cover provided with a small valve. Next, by means of this valve, a preset quantity of inert gas under pressure is injected which mixes with the amount of fluid constituting the actual charge of container. For the discharge of product contained in the aerosols, it is sufficient to open the valve; the difference in pressure inside the aerosols and the atmosphere thus causes the gas to expand which, on exiting, carries with it particles of fluid products mixed, with it, the gas serving as propellant agent.

These aerosols, inspite of that fact that they have been extremely developed for a variety of applications, and are easy and economical to make and use, still present considerable shortcomings.

First, because of the presence of gas under pressure in the interior, in case of prolonged exposure to heat sources or to a fall, they may burst due to gas expansion thus causing harm to nearby people. This phenomenon may in occur, for instance, with tanning products being used on sunny beaches, with foodstuffs used in the kitchen near the stoves, or with any cylinders being virtually empty of product, yet containing an amount of gas under pressure, which are left in garbage or at disposal of boys who may play with striking them with stones, nails and the like. Another shortcoming is the substantial increase in air pollution due to the excessive use of inert gases, such as, for instance, Freon and the like, released into the atmosphere. Such gases, in fact, although "per se" not causing immediate harm to users, yet, they form, by accumulating in the atmosphere, screen preventing ultraviolet rays from going through.

A further shortcoming is the fact that the continuous spray of products containing these inert gases, such as Freon and the like, causes harm to the skin.

In addition, the inert gases utilised, being mixed with the product to be dispensed and remaining in contact with said product for a rather long period of time, may cause alteration in the characteristics of the product.

The object of this invention is to overcome the draw mentioned hereinabove.

According to the present invention, the dispenser, which does not present the above-said shortcomings, consists of a chamber which contain the fluid to be dispensed, provided with a dispensing valve and a propellant to thrust the fluid through said valve, in which the fluid to be dispensed and the propellant are housed into two distinct, coaxial chambers separated by a seal sliding piston.

The propellant may be compressed air the pressure of which is sufficient to enable total dispensing of the the fluid. Compressed air is preferably contained in a separate chamber angularly and coaxially externally positioned to the chamber containing fluid to be dispensed; this chamber communicates with the lower part of chamber containing fluid to be dispensed, below seal piston, through radial holes.

Alternatively, the propellant may be of the mechanical type, such as, for instance, a spiral spring, positioned in a chamber coaxial with that containing the fluid to be dispensed and below the latter, separation between the two chambers being ensured by the seal sliding piston. The diameter of the chamber into which the spring is positioned may be equal to or less than that of the chamber containing the fluid to be dispensed.

The dispenser of this invention presents the following advantages over known dispensers:

- the fluids to be dispensed are separated from the propellant and in no way polluted by the latter;
- the propellants are not "per se" pollutant, being of the mechanical type or being compressed air;
- the chambers constituting the dispensers are of simple and economical construction, easy to assemble and are used exactly as the known aerosols;
- the dispensers are thoroughly harmless because fluid or liquid products are not mixed with gas under pressure;
- atomization of liquid products or dispensing of the fluid in general happens in the same way as with known aerosols, but with the appreciable difference that they are not polluted by propellant gases;
- the propulsion occurs by means of a charge of mechanical member, such as, for instance, a simple calibrated spiral spring, preferably conical having decreasing wire section, or by means of a compressed air charge, separated from the fluid or liquid products to be dispensed.

The dispenser of this invention may be better understood by reference to the detailed description which follows, and the figures representing some preferred, illustrative but not restrictive embodiments, of this invention, in which.

Figure 1:
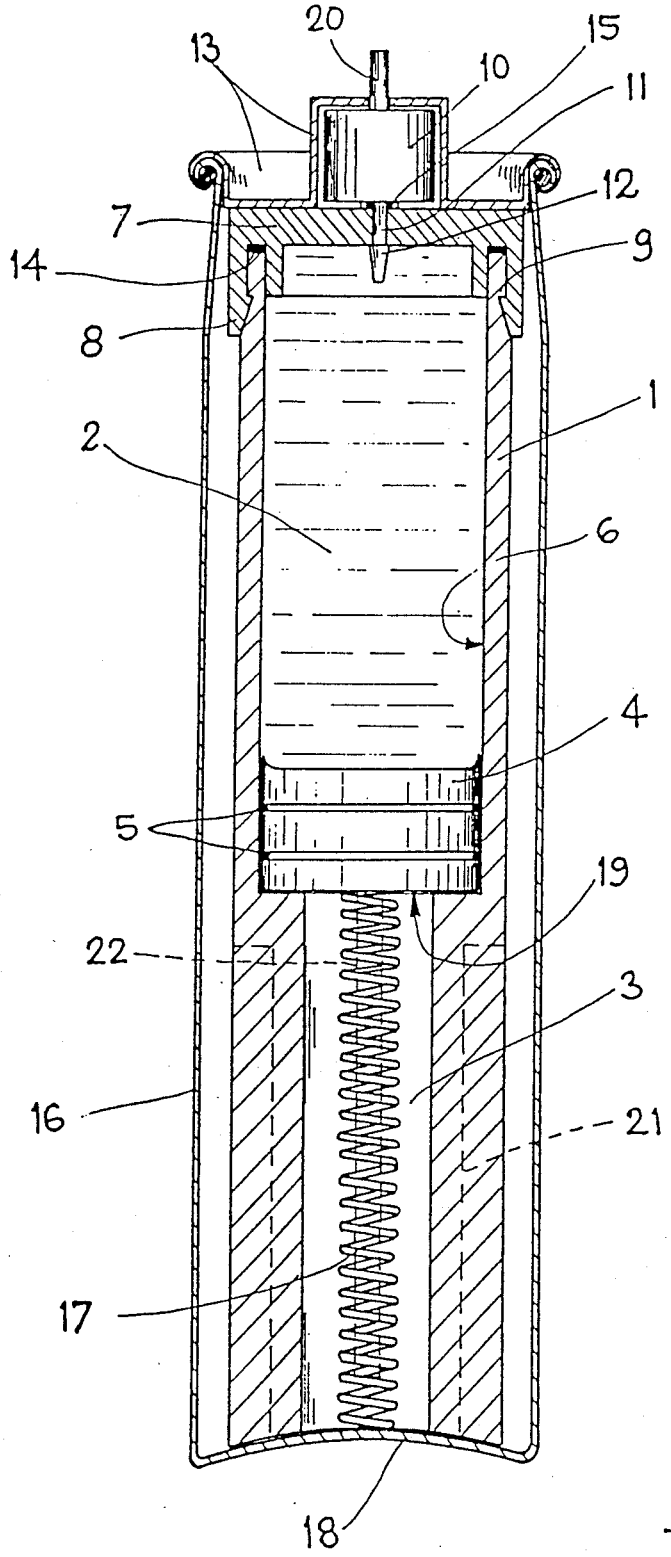
FIG. 1 is a schematic view of the longitudinal section of a preferred but not restrictive form of construction of the dispenser of this invention.

In FIG. 1, the dispenser for fluid and liquid products usually comprises an outer envelope 16 and an inner hollow body 1, in the upper part of which a chamber 2 and in lower part of which a coaxial conduit 3 are made. On the bottom of the upper chamber 2 a sliding piston 4 is positioned, provided with additional seals 5, of which the outer part presses tightly on inner surface 6 of the chamber 2. The chamber 2, with bottom closed by seal piston 4, is filled with fluid or liquid to be dispensed. Its upper part is then closed by a pressure inner cover 7, the outer edge of which 8 couples to projection 9 of the upper edge of the chamber. Piston 4 is preferably constructed of sufficiently flexible and elastic material such as to ensure its smooth sliding along said inner surface 6, and a thorough seal of fluid or liquid contained in chamber 2. On pressure inner cover 7 a dispensing valve 10 is fitted, of substantially conventional type, which has lower discharge conduit 11 which goes through it and due to its oversize edge 12 which engages with said cover 7. An upper cover 13 is placed to cover the dispensing valve 10, which cover rests and presses on inner cover 7, which is equipped with seal 14. Analogously, a seal 15 is fitted also between dispensing valve 10 and said inner cover 7, around the lower discharge conduit 11. In these conditions, hollow body 1 is inserted into outer envelope 16, after which a completely relaxed spiral spring 17 is inserted into coaxial lower conduit 3, and having a height at least equal to that of envelope 16. Preferably, the spiral spring is conical having decreasing wire section. During insertion of hollow body 1 into envelope 16, spring 17 is compressed between inner surface of the bottom 18 of said outer envelope and bottom 19 of piston 4. When the entire hollow body 1 has been inserted, the outer edge of upper opening of the outer envelope 16 enters into engagement with the outer edge of upper cover 13, and together they are constrained. The upper discharge conduit 20 of dispensing valve 10, protrudes from upper cover 13. Hollow body 1, as may be observed from the figure, may present a continuous outer surface, or a lowered section in the part corresponding to lower conduit 3. Besides, piston 4 may be provided with a lower pin 22 in order to provide a possible guide for spring 17. Features of spring 17, such as wire diameter, wire-winding diameter, number of turns, constant of elasticity, etc., may be varied according to quantity and type of fluid or liquid product contained in upper chamber 2. As may be gathered from what has been illustrated and described above, the pressure, necessary in order that liquid or fluid contained in upper chamber 2 may exit from valve 10 each time pressure is exercised by spring 17 which tries to return to its natural state not under tension charged. Pre-compressed spring 17 thus thrusts upwards piston 4 each time that, by opening upper dispensing valve 10, chamber 2 is put into communication with the outer environment. Thus, liquid or fluid present in chamber 2 is propelled outwards. Each time dispensing stops, the strokes of spring 17 and piston 4 are arrested as due to the opposite force exercised by liquid or fluid still imprisoned inside chamber 2. Pre-charge of spring 17 therefore must be sufficient to enable total expelling of, quantity of liquid or fluid inserted into chamber 2. Therefore, sliding of piston 4 inside chamber 2 and relaxation of spring 17 are according to quantity of fluid or liquid dispensed at each opening of valve 10.

When liquid or fluid contained in chamber 2 is totally discharged by thrust produced by piston 4, through spring 17, the latter shall be almost entirely relaxed and the piston will be entirely thrust against inner cover 7.

Figure 2:
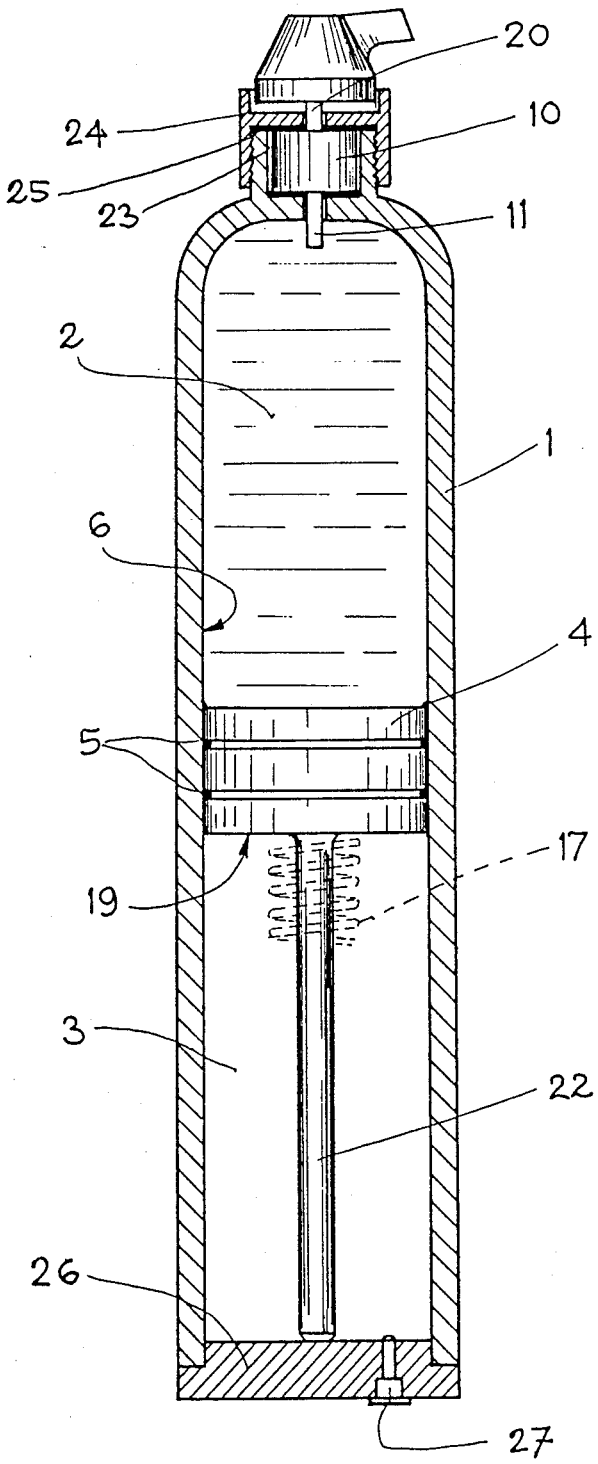
FIG. 2 is a schematic view of the longitudinal section of a second form of construction of this dispenser and FIG. 3 is a, schematic view of the longitudinal section of a third form of construction of this dispenser in which the propellant medium is compressed air.

FIG. 2 represents a second preferred embodiment of the dispenser of this invention, in which hollow body 1 presents the upper chamber 2 and the lower coaxial conduit 3, substantially of equal diameter and separated by piston 4 only, equipped with additional seals 5.

Upper part of hollow body 1 is provided with a seat 23 in which dispensing valve 10 is fitted, which is kept in position by means of a closing cover 24 equipped with seals 25.

On its outer surface 19, piston 4 is equipped with a pin 22 which, during filling of chamber 2, rests on surface of bottom 26. When filling of chamber 2, with liquid or fluid to be dispensed, is completed and valve 10 and closing cover 24 are locally sealed, propellant is inserted into lower coaxial conduit 3 from lower section of hollow body 1. This propellant may consist of a spiral spring 17, as already illustrated and described in the embodiment of FIG. 1, kept in position by bottom cover 26 suitably sealed to conform with shape of the hollow body 1. Alternatively, spring 17 may instead by replaced by an adequate compressed air charge, injected into the coaxial conduit 3 through valve 27, after which the bottom 26 is tight-sealed with outer wall of hollow body 1.

Pressure spring 17, in addition to a form cylindrical spiral form with round wire, may be of other configuration, such as, for instance, of quadrangular winding, into a conduit 3 of same type, of quadrangular wire section, or with spring of superimposed cup type or with other known mechanical means.

Figure 3:
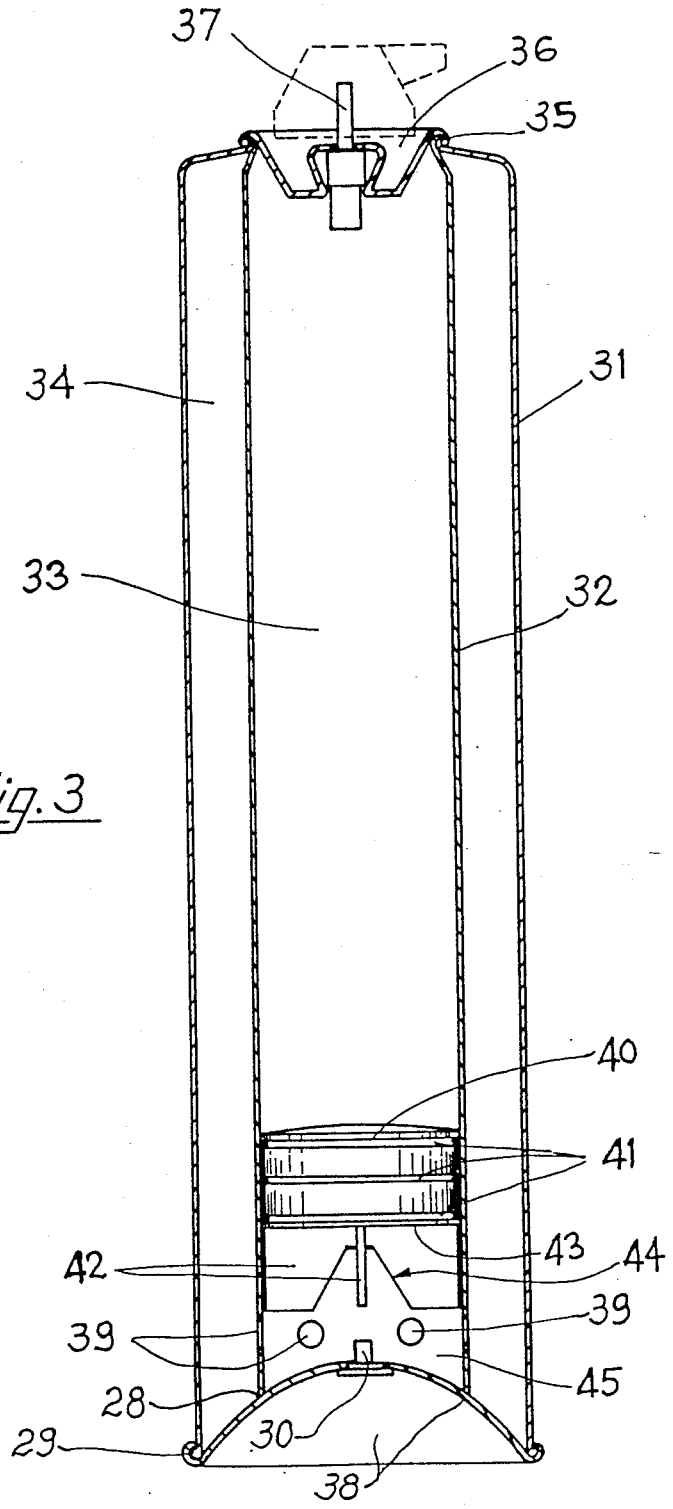

FIG. 3 shows another embodiment of dispenser for fluid and liquid products. It comprises two tubular containers 31 and 32, concentrically and coaxially placed such as to form an inner chamber 33, substantially cylindrical, and an outer annular chamber 34. In their upper part containers 31 and 32 are held constrained to each other by means of hermetic seal 35, on which the supporting and constraining cover 36 of dispersing valve 37 is sealed.

In their lower part containers 31 and 32 are embedded in the bottom 38, preferably convex towards the center so as to withstand the inner pressure better. Lower outer edge of outer tubular container 31 is hermetically constrained to bottom 38 by means of an outer riveting 29, while the lower outer edge 28 of inner tubular container 32 may simply be rested on inner surface of bottom 38.

In its lower part, the inner tubular container 32 presents several radial holes 39, and in its inner part a sliding piston 40 is positioned, equipped with outer seals 41 and lower guiding fins 42. At its lower dead center, piston 40 is placed in such a position that radial holes 39, of inner tubular container 32, are below the bottom 43 and substantially aligned with lower guiding fins 42. The latter, in their central area 44, are V-cut so as to form a free space in which inner end of the filling valve 30 applied to bottom 38 extends. Dispenser charge envisages filling of the central chamber 33 with the fluid or liquid product to be dispensed. Filling requires sliding of piston 40 up to its lower dead center, with ends of guiding fins 42 resting on surface of bottom 38.

Next, through filling valve 30, compressed air is injected which, through radial holes 39, provides filling the annular chamber 34. During this stage piston 40 remains in its position as the central chamber 33 is filled with fluid or liquid product to be dispensed which cannot be compressed.

After the chamber 33 is totally filled, the chamber 33 results full of fluid or liquid product to be dispensed, whereas annular chamber 34 and the lower secondary one 45, which is located below piston 40 and delimited by the fins 42, result full of compressed air. Volume proportions of chamber 33 and 34 are such that air volume and charging pressure are proportional to volume of fluid or liquid product to be dispensed. Ratio of said volumes is therefore such that total expansion of compressed air allows total evacuation of fluid contained in chamber 33.

For dispensing, it is sufficient that user operates the dispenser in the usual way used for "spray" aerosols.

On pressing valve 37, inner chamber 33 is put into communication with the atmosphere and liquid contained in it is thrust outwards by means of the action of piston 40, thrust upwards by pressure exercised on its bottom 43 by compressed air which tends to expand.

As the pressure on valve 37 is applied, the fluid or liquid is expelled outwards, in atomized or non atomized form due to the continuous thrust that expansion of compressed air contained in annular 34 and lower chamber 45 exercises on bottom 43 of piston 40 which, in turn, moves progressively upwardly exercising a continuous thrust on the liquid contained in chamber 33.

Whereas preferred construction envisages the employ of compressed air as simpler to carry, easier to use for charging, cheaper and non polluting, it is however clear that with same principle other types of gas may be used. Whatever the type used, expansion of gas or air or spring inside the dispenser is such that at the end, that is, when dispenser is substantially empty of fluid or liquid product, the residual inner pressure is substantially negligible and absolutely harmless.

The embodiments illustrated and described hereinabove are given for purely illustrative purposes and not intended to be limiting. Of course several variations and modifications may be brought both as regards dispensing system and dispenser configuration which may be either parallepipedal, polygonal, ovoid or other, although the simplest and the least expensive is obviously the cylindrical configuration.

I claim:

1. A dispenser for flowable materials which comprises: a tubular outer container having an open lower end, a tubular inner container having an open lower end positioned coaxially and concentrically within the outer container, an outer annular chamber between said outer and said inner container for compressed air, said outer container and said inner container each having an upper end, said upper ends being sealed, a first valve positioned on said sealed ends for ejection of said flowable material, a convex bottom sealed to the lower ends of said outer container and said inner container, a filling valve on said convex bottom, a piston slidable within said inner container defining in the inner tubular container an upper chamber for the flowable material and a second lower chamber between said piston and said bottom for the compressed air, said piston being provided with lower guiding fins projecting diametrically across the lower surface thereof into said second lower chamber, radial holes in the lower part of said inner tubular container for communicating said outer annular chamber with said second lower chamber, said piston being made of flexible elastic material, said radial holes being below the bottom and being aligned with said guiding fins, said fins being V-cut in the lower central portion thereof, whereby a free space for said filling valve is provided.

* * * * *